US006992273B2

(12) United States Patent
Yim et al.

(10) Patent No.: US 6,992,273 B2
(45) Date of Patent: Jan. 31, 2006

(54) COMBINATION HOOD MICROWAVE OVEN

(75) Inventors: Ki Yong Yim, Seoul (KR); Sang Bum Sohn, Seoul (KR); Ho Seon Rew, Seoul (KR); Sung Bae Song, Anyang (KR); Jong Hoon Kim, Gunpo (KR); Young Min Lee, Incheon (KR); Han Rim Song, Goyang (KR); Myoung Sik Kim, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/757,989

(22) Filed: Jan. 16, 2004

(65) Prior Publication Data

US 2005/0092745 A1 May 5, 2005

(30) Foreign Application Priority Data

Nov. 3, 2003 (KR) ..... 10-2003-0077371

(51) Int. Cl.
*H05B 6/80* (2006.01)

(52) U.S. Cl. ..... 219/757; 126/21 A

(58) Field of Classification Search ..... 219/757, 219/756, 758, 681, 391, 400, 702; 126/21 A, 126/21 R, 299 D, 299 R, 273 A
See application file for complete search history.

(56) References Cited

U.S. PATENT DOCUMENTS 6,018,158 A * 1/2000 Kang ..... 219/757
6,621,058 B1 * 9/2003 Kim ..... 219/757
6,797,930 B2 * 9/2004 Kim ..... 219/757

FOREIGN PATENT DOCUMENTS

JP 63251740 A * 10/1988

* cited by examiner

*Primary Examiner*—Quang Van
(74) *Attorney, Agent, or Firm*—Birch, Stewart, Kolasch & Birch, LLP

(57) ABSTRACT

Disclosed is a combination hood microwave oven, by which a room environment is maintained more pleasant and fresh by proving a microwave oven with an air curtain generating unit for preventing polluted air, which includes hot, smelling, or humid air produced from an oven range on cooking, from diffusing into a room. The present invention includes a cabinet disposed over an oven range, a cooking room having a predetermined cavity within the cabinet for cooking using an electromagnetic wave generated from a magnetron, a hood unit installed within the cabinet to discharge polluted air produced from the oven range on cooking, and an air curtain generating unit installed at a bottom side of the cabinet to prevent the polluted air from diffusing into a room.

11 Claims, 8 Drawing Sheets

COMBINATION HOOD MICROWAVE OVEN

This Nonprovisional application claims priority under 35 U.S.C. §119 (a) on Patent Application No(s). 10-2003-0077371 filed in Korea on Nov. 3, 2003, the entire contents of which are hereby incorporated by reference.

BACKGROUND OF THE INVENTION

1. Field of the Invention

The present invention relates to a microwave oven equipped with a hood function, and more particularly, to a combination hood microwave oven equipped with an air curtain function of preventing polluted air generated from cooking from diffusing into a room.

2. Background of the Related Art

Generally, a combination hood microwave oven (over the range), which is installed over an oven range, is a combination home appliance equipped with a cooking function using a microwave and a function of discharging polluted air generated from the oven range on cooking outside a room or purifying the polluted air to circulate in the room.

FIG. 1 is a side view of a combination hood microwave oven installed over an oven range according to a related art, and FIG. 2 is a cross-sectional view of a combination hood microwave oven according to a related art.

Referring to FIG. 1 and FIG. 2, a combination hood microwave oven according to a related art is installed at an upper wall 132 of a room over an oven range 102 to perform a function of discharging polluted air generated from cooking in the oven range 102 as well as a cooking function. The combination hood microwave oven 104 is installed to communicate with a discharge passage 106 to discharge the polluted air outside the room.

Such a combination hood microwave oven 104, as shown in FIG. 2, consists of a cabinet 110 having a predetermined cavity inside, an electronic device unit 114 installed at one side in the cabinet 110 and having a magnetron 112 to generate an electromagnetic wave, and a cooking room 118 provided with a rotational tray 116 on which food is placed to be cooked using the electromagnetic wave generated from the magnetron 112.

An air passage 120, through which air passes, is provided within the cabinet 110. An inlet opening 122, via which the polluted air generated from the oven range on cooking is sucked, is formed at a bottom of the cabinet 110. An outlet opening 124, via which the air having passed through the air passage 120 is discharged outside, is formed at a top of the cabinet 110. And, a dual-intake sirocco fan 126 generating a suction force is installed at one side of the outlet opening 124.

The outlet opening 124 is connected to the discharge passage 106 via an air duct 130 so that the polluted air discharged through the outlet opening 124 passes through the air duct 130 to be discharged via the discharge passage 106.

An operation of the related art combination hood microwave oven is explained as follows.

In cooking using the microwave oven 104, a user opens a door (not indicated by a reference designation) to place food on the rotational tray 116 inside the cooking room 118. Once a cooking button is pressed, the rotational tray 116 rotates together with the food and, simultaneously, the electromagnetic wave is generated from the magnetron 112 to radiate inside the cooking room 118 for performing the function of cooking the food.

Meanwhile, when cooking is performed using the oven range 102 installed under the microwave oven 104, the user presses a hood operation button (not shown in the drawing). The dual-intake sirocco fan 126 is then driven to generate the suction force to suck the polluted air including hot, smelling, or humid air via the inlet opening 122 at the bottom of the cabinet 110. The sucked air passes through the air passage 120 provided within the cabinet 110 to be discharged outside the cabinet 110 via the outlet opening at the top of the cabinet 110. The air discharged via the outlet opening 124 is then discharged outside the room via the discharge duct 130 and the discharge passage 106 provided in the wall.

However, in the related art combination hood microwave oven, an area of the inlet opening 122, as shown in FIG. 3, is limited to be smaller than a cooking area of the oven range 102. Hence, a portion of the polluted air including the hot, smelling, or humid air produced from the oven range 102 fails to be sucked into the cabinet via the inlet opening 122 but diffuses into the room to pollute the room air and to cause unpleasantness.

SUMMARY OF THE INVENTION

Accordingly, the present invention is directed to a combination hood microwave oven that substantially obviates one or more problems due to limitations and disadvantages of the related art.

An object of the present invention is to provide a combination hood microwave oven, by which a room environment is maintained more pleasant and fresh by proving a microwave oven with an air curtain generating unit for preventing polluted air, which includes hot, smelling, or humid air produced from an oven range on cooking, from diffusing into a room.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a combination hood microwave oven according to the present invention includes a cabinet disposed over an oven range, a cooking room having a predetermined cavity within the cabinet for cooking using an electromagnetic wave generated from a magnetron, a hood unit installed within the cabinet to discharge polluted air produced from the oven range on cooking, and an air curtain generating unit installed at a bottom side of the cabinet to prevent the polluted air from diffusing into a room.

The air curtain generating unit includes a blowing fan rotatably provided to a front bottom side of the cabinet, a drive motor rotating the blowing fan, and a fan housing formed at the front bottom side of the cabinet to hold the blowing fan therein and having an intake opening for inhaling air and an outflow opening for exhaling air to form an air curtain.

The blowing fan is a crossflow fan having a configuration that the air is inhaled and exhaled in a circumferential direction when the fan is rotated by the drive motor.

The fan housing is formed at the front bottom side of the cabinet in a length direction, the intake opening faces a front side of the microwave oven, and the outflow opening inclines to a lower direction of the microwave oven to have a predetermined incline angle so that the air forming the air curtain is injected toward an upper front side of the oven range.

The air curtain generating unit includes a front air curtain generating unit installed at the front bottom side of the cabinet to form a front air curtain inclining to a front lower side of the cabinet, a left air curtain generating unit installed at a left bottom side of the cabinet to form a left air curtain inclining to a left lower side of the cabinet, and a right air curtain generating unit installed at a right bottom side of the cabinet to form a right air curtain inclining to a right lower side of the cabinet.

And, the air curtain generating unit includes a sliding plate provided to the bottom side of the cabinet to slide out in front of the cabinet to a predetermined displacement, a crossflow fan rotatably installed at a front side of the sliding plate to form an air curtain by inhaling/exhaling air, and a drive motor rotating the crossflow fan.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
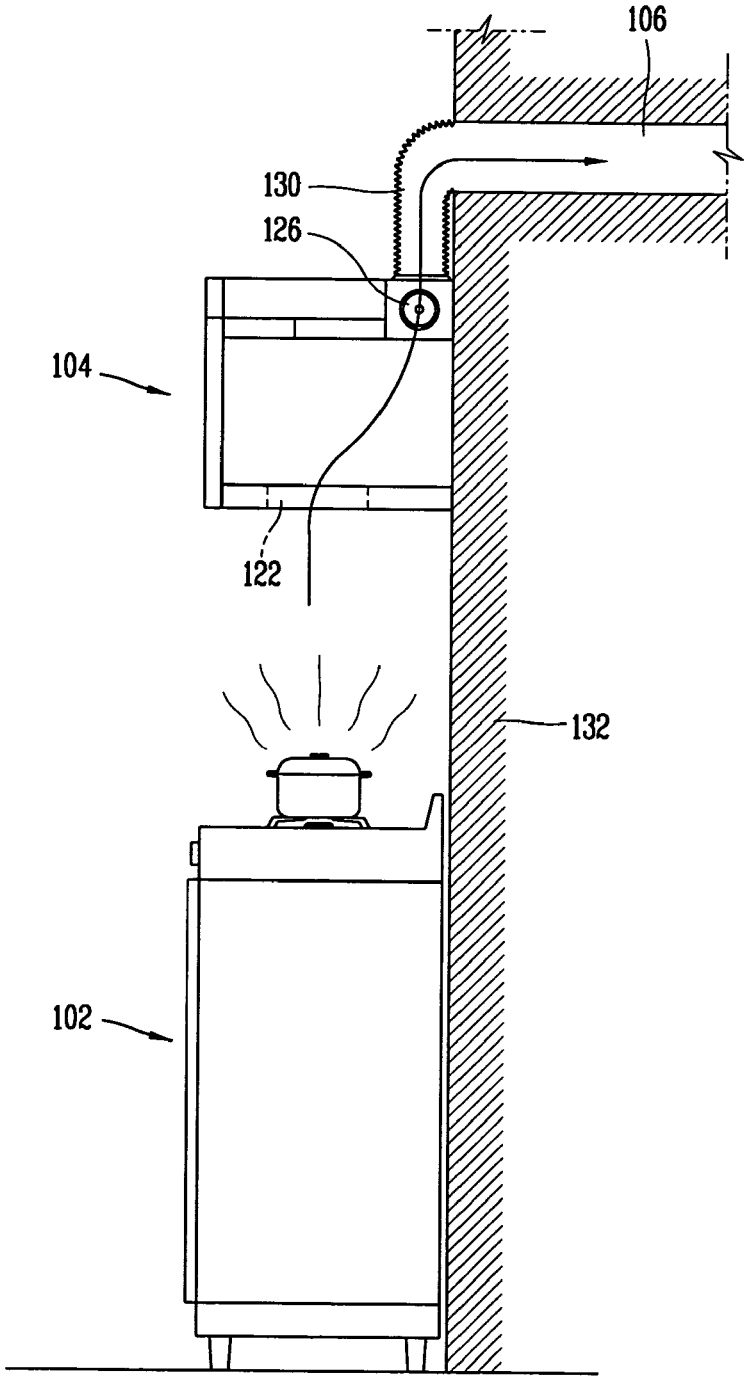
FIG. 1 CONVENTIONAL ART
FIG. 1 is a side view of a combination hood microwave oven installed over an oven range according to a related art.
Figure 2:
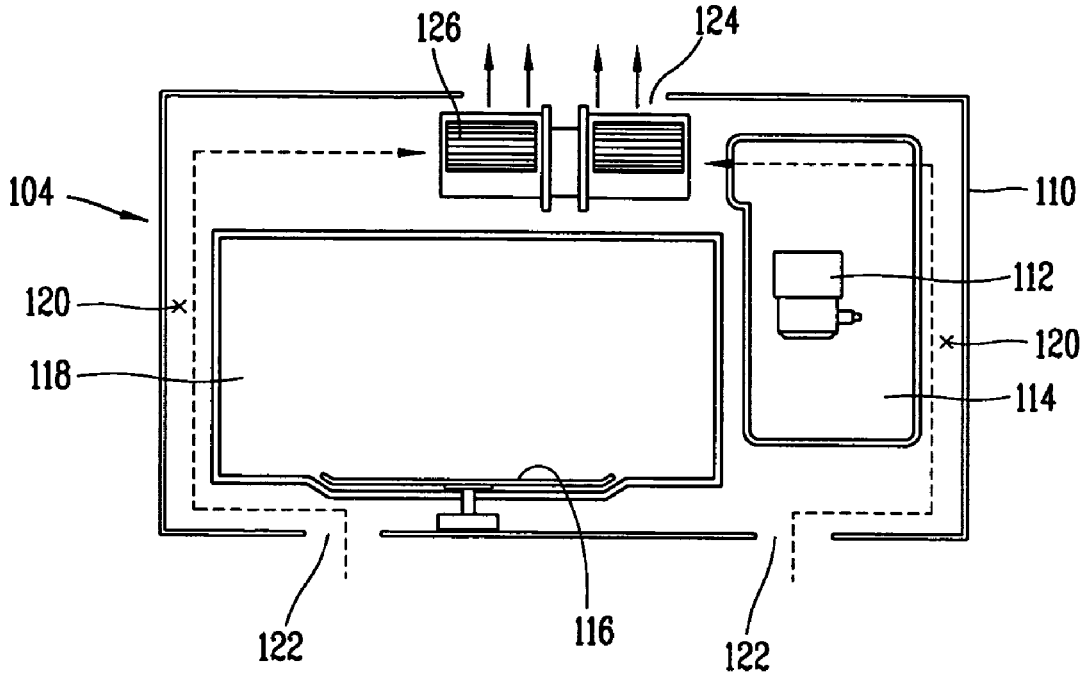
FIG. 2 CONVENTIONAL ART
FIG. 2 is a cross-sectional view of a combination hood microwave oven according to a related art.
Figure 3:
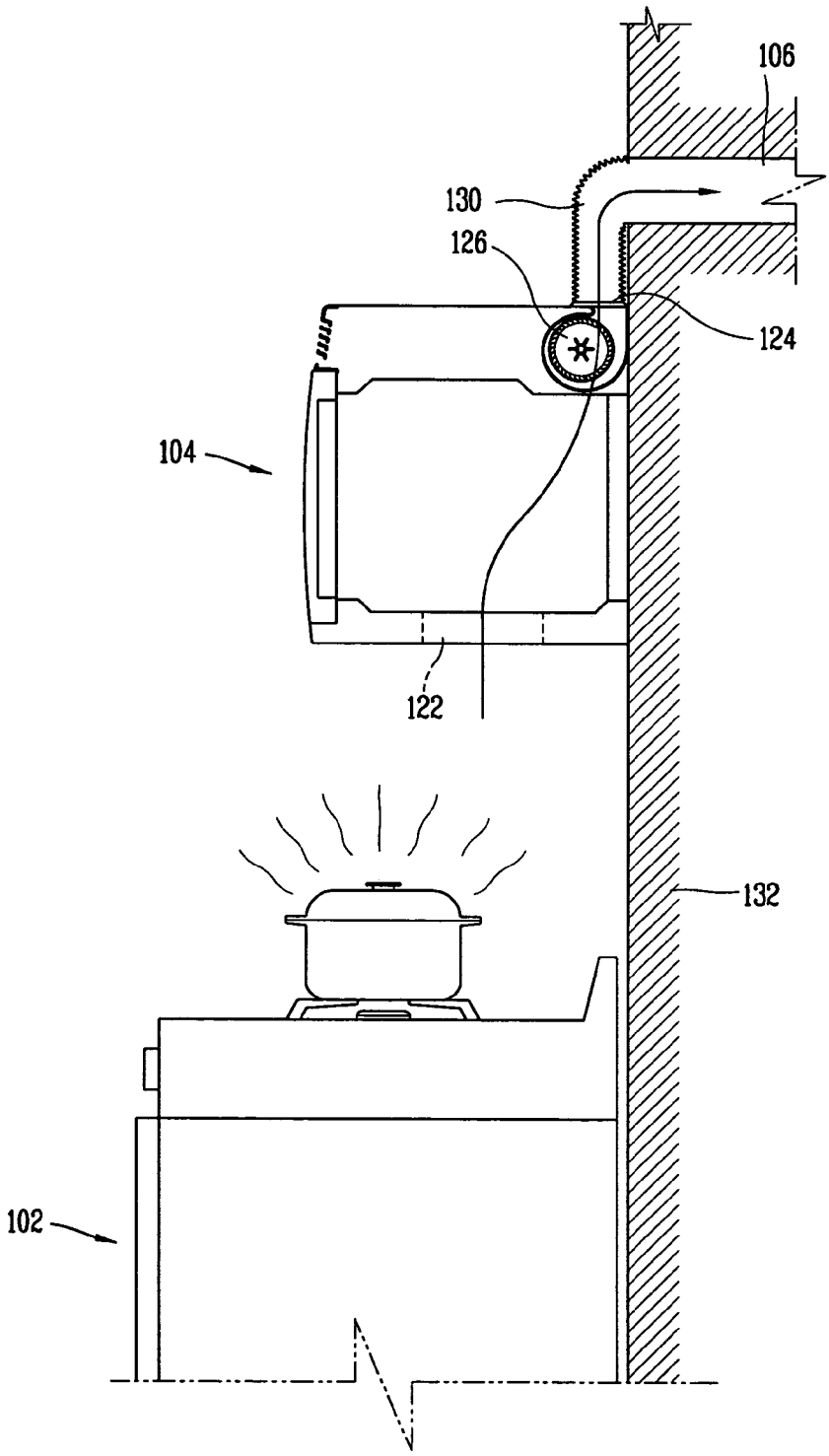
FIG. 3 is a side view of a combination hood microwave oven in use according to a related art.
Figure 4:
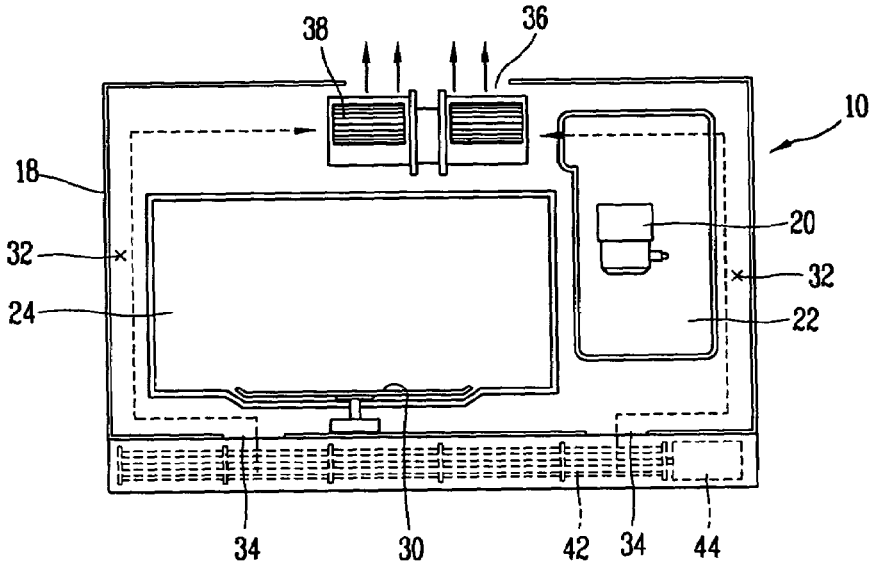
FIG. 4 is a cross-sectional view of a combination hood microwave oven according to the present invention.
Figure 5:
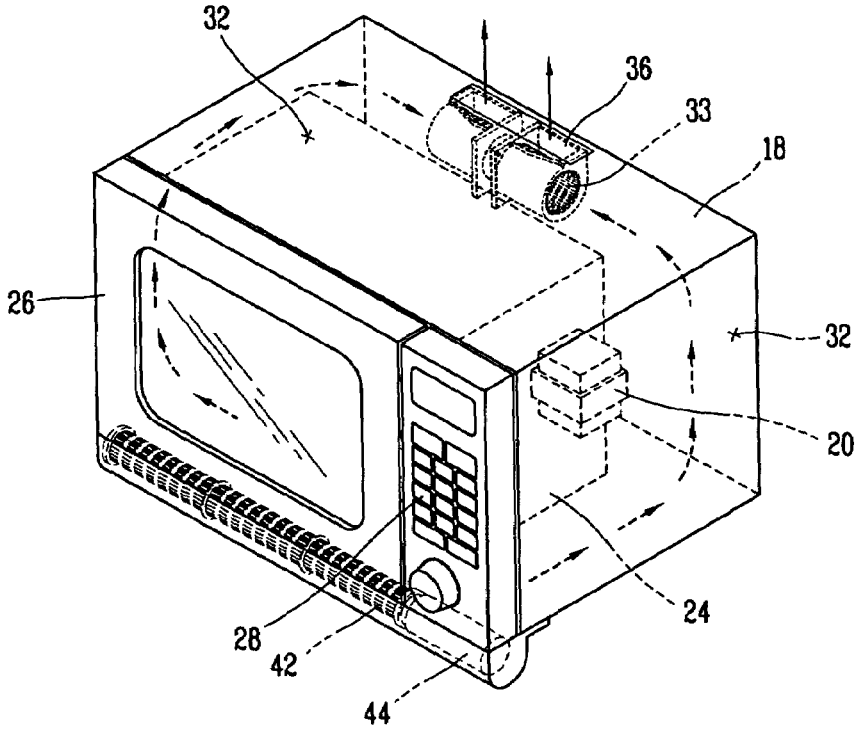
FIG. 5 is a perspective view of a combination hood microwave oven according to a first embodiment of the present invention.
Figure 6:
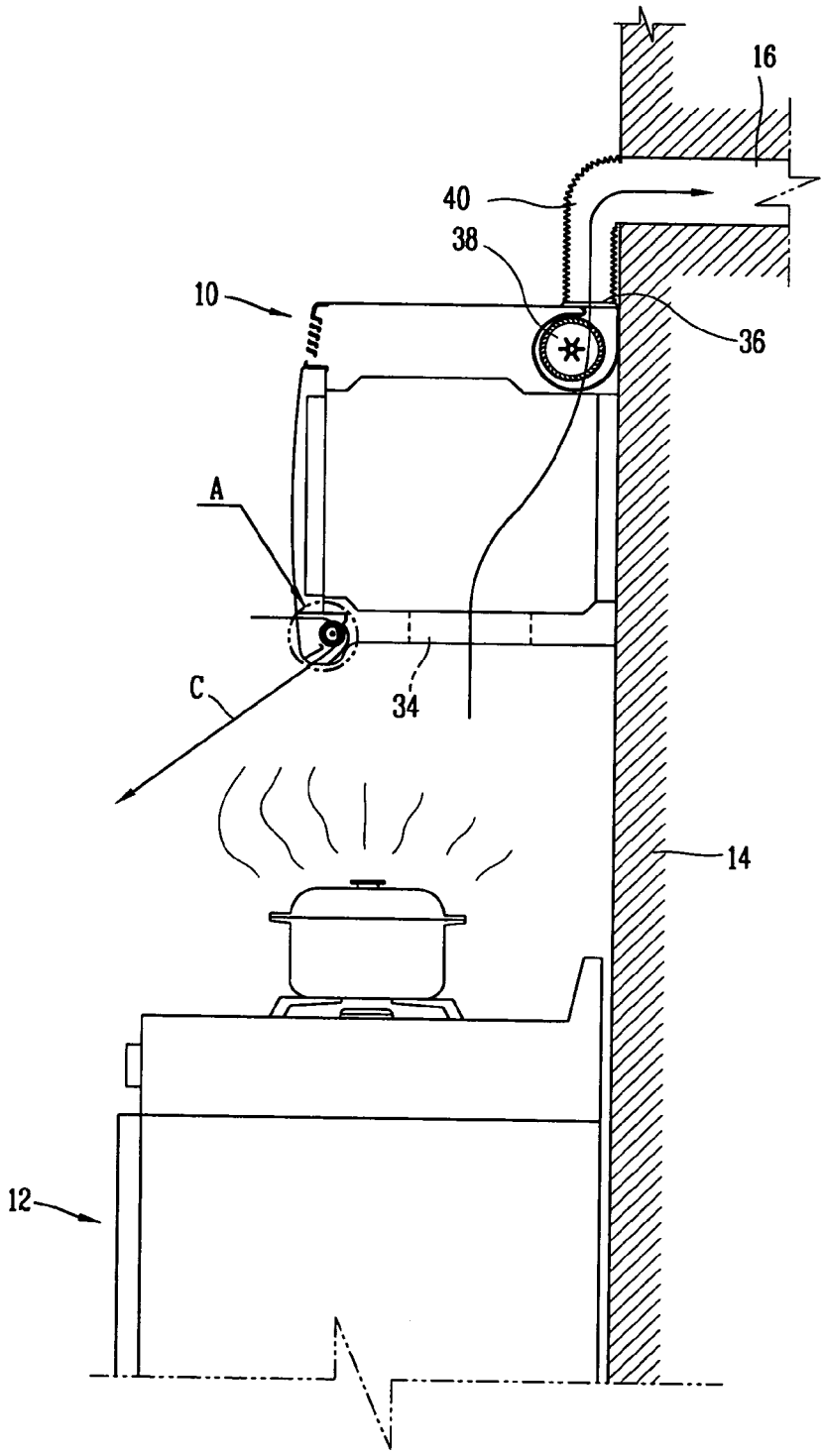
FIG. 6 is a side view of a combination hood microwave oven in use according to a first embodiment of the present invention.

FIG. 4 is a cross-sectional view of a combination hood microwave oven according to the present invention, FIG. 5 is a perspective view of a combination hood microwave oven according to a first embodiment of the present invention, and FIG. 6 is a side view of a combination hood microwave oven in use according to a first embodiment of the present invention.

Referring to FIG. 4 to FIG. 6, a combination hood microwave oven according to a first embodiment of the present invention includes a cabinet 18 disposed over an oven range 12 to leave a predetermined distance from the oven range 12 to be fixed to an inner wall 14 of a room, an electronic device unit 22 installed at one side in the cabinet 18 and having a magnetron 20 generating an electromagnetic wave, a cooking room 24 having a predetermined cavity within the cabinet 18 for cooking using the electromagnetic wave generated from the magnetron 20, a hood unit installed within the cabinet 18 to discharge polluted air produced from the oven range 12 on cooking outside the room, and an air curtain generating unit installed at a bottom side of the cabinet 18 to prevent the polluted air from diffusing into the room.

A door 26 is installed at a front side of the cabinet 18 to open/close, and various operation buttons 28 are provided at the front side of the cabinet 18. A rotational tray 30 is installed on a bottom of the cooking room 24.

The hood unit includes an air passage 32 guiding air flowing in the bottom side of the cabinet 18 to a top side of the cabinet 18, an inlet opening 34 formed at the bottom side of the cabinet 18 to suck the air, an outlet opening 36 formed at the top side of the cabinet 18 to discharge the air having passed through the air passage 32 outside the cabinet 18, a dual-intake sirocco fan 38 installed at one side of the air passage 32 in the vicinity of the outlet opening 36 to generate a suction force.

The outlet opening 36 is connected to an air duct 40, and the air duct 40 is connected to a discharge passage 16 penetrating into the wall 14 to communicate with an external environment.

Figure 7:
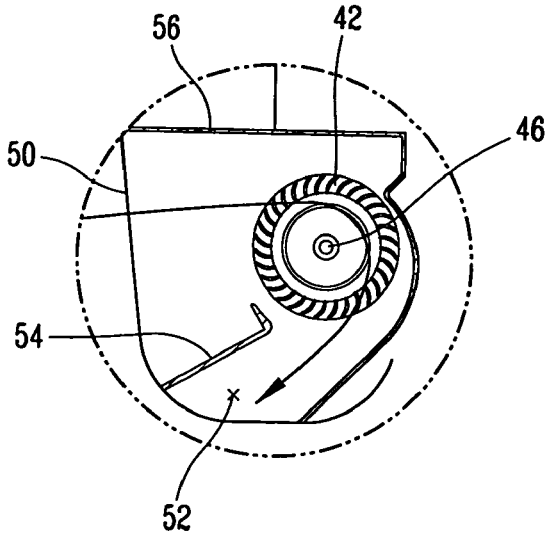
FIG. 7 is a magnified view of a part 'A' in FIG. 6.

The air curtain generating unit, as shown in FIG. 7, includes a blowing fan 42 rotatably installed at a front end of the bottom side of the cabinet 18 in a length direction of the microwave oven 10, a drive motor 44 connected to a rotational shaft 46 of the blowing fan 42 to rotate the blowing fan 42, an intake opening 50 formed at a front side of the bottom side of the cabinet 18 to have the blowing fan 42 loaded therein and to suck air, and a fan housing 56 having an outflow opening 52 blowing out the air forming an air curtain.

In this case, the blowing fan 42 is preferably a crossflow fan having a configuration that air is inhaled and exhaled in a circumferential direction when the fan is rotated by the drive motor 44. In the fan housing 56, the intake opening 50 is separated from the outflow opening 52 by a diaphragm 54. The intake opening 50 faces a front side of the microwave oven 10, and the outflow opening 52 inclines to a lower direction of the microwave oven 10 to have a predetermined incline angle so that the air forming the air curtain C is injected toward an upper front side of the oven range 12.

An operation of the above-constructed combination hood microwave oven is explained as follows.

In cooking using the microwave oven 10, a user opens the door 26 to place food on the rotational tray 30 inside the cooking room 24. Once the cooking button 28 is pressed, the rotational tray 30 rotates together with the food thereon and, simultaneously, the electromagnetic wave is generated from the magnetron 20 to radiate inside the cooking room 124 for cooking the food.

Meanwhile, when cooking is performed using the oven range 12 installed under the microwave oven 10, the user presses a hood operation button to drive the dual-intake sirocco fan 38. The suction force is then generated to suck the polluted air including hot, smelling, or humid air via the inlet opening 34 at the bottom side of the cabinet 18. The sucked air passes through the air passage 32 provided within the cabinet 18 to be discharged outside the cabinet 18 via the outlet opening 36. The air discharged via the outlet opening 36 is then discharged outside the room via the discharge duct 40 and the discharge passage 16 provided in the wall.

In doing so, the air curtain generating unit is actuated so that the polluted air produced from the oven range 12 on cooking is sucked into the cabinet via the inlet opening 34 instead of diffusing into the room.

Namely, as the drive motor 44 of the air curtain generating unit is driven, the blowing fan 42 rotates. Hence, the air is sucked from the front side of the cabinet 18 via the intake opening 50 of the fan housing 56 by a negative blowing force of the blowing fan 42, and is then blown out via the outflow opening 52 to form the air curtain C.

In this case, the outflow opening 52 inclines downward at a predetermined incline angle, whereby the air flowing out of the outflow opening 52 is blown out toward the upper front side of the oven range 12 to cut off the diffusion of the polluted air into the room.

Figure 8:
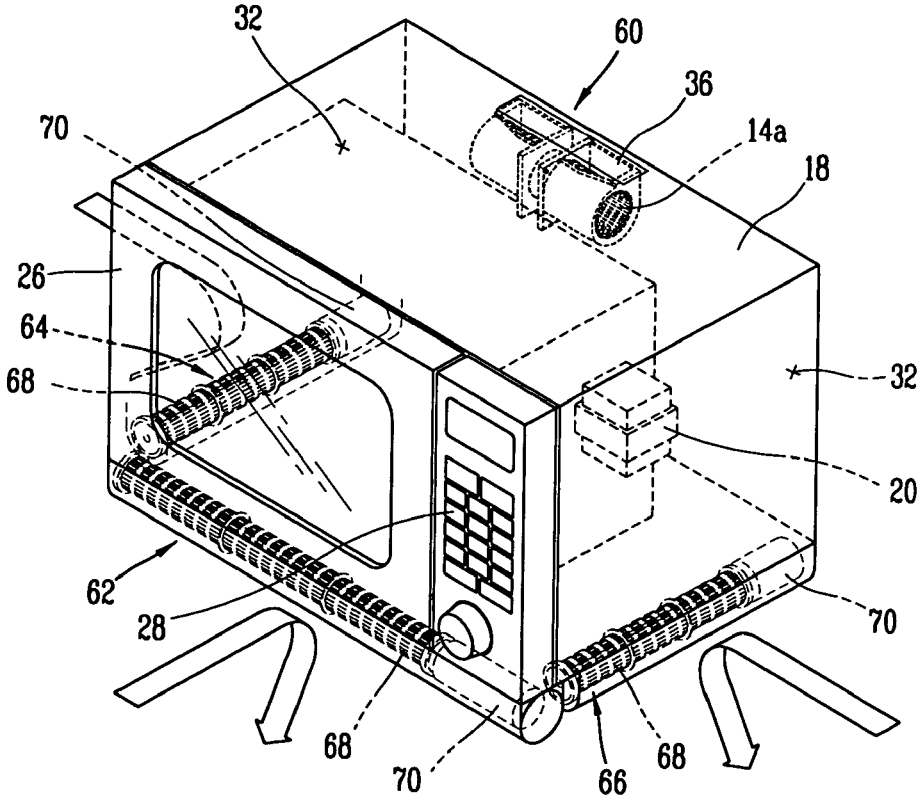
FIG. 8 is a perspective view of a combination hood microwave oven according to a second embodiment of the present invention.

FIG. 8 is a perspective view of a combination hood microwave oven according to a second embodiment of the present invention.

Referring to FIG. 8, a combination hood microwave oven according to a second embodiment of the present invention has the same construction of the first embodiment of the present invention but differs in configuration of an air curtain generating unit.

Namely, an air curtain generating unit according to a second embodiment of the present invention includes a front air curtain generating unit 62 installed at a lower front side of the cabinet 18 in a length direction of the cabinet 18 to form a front air curtain inclining to a lower side at a predetermined angle and right and left air curtain generating units 64 and 66 installed at right and left lower sides of the cabinet 18 to form right and left air curtains inclining to right and lower sides at predetermined angles, respectively.

Each of the front, right, and left air curtain generating units 62, 64, and 66 including a blowing fan 68 and a drive motor 70, which has the same construction of the air curtain generating unit of the first embodiment of the present invention.

Moreover, in case that the front, right, and left air curtain generating units 62, 64, and 66 include the blowing fans 68, respectively, the three blowing fans 68 can be connected to be driven by one drive motor 70.

The air curtain generating unit according to the second embodiment of the present invention forms the air curtains at the right and left sides of the oven range 12 as well as the front side of the oven range 12, whereby the polluted air produced from the oven range 12 on cooking is completely cut off to minimize the diffusion of the polluted air into the room.

Figure 9:
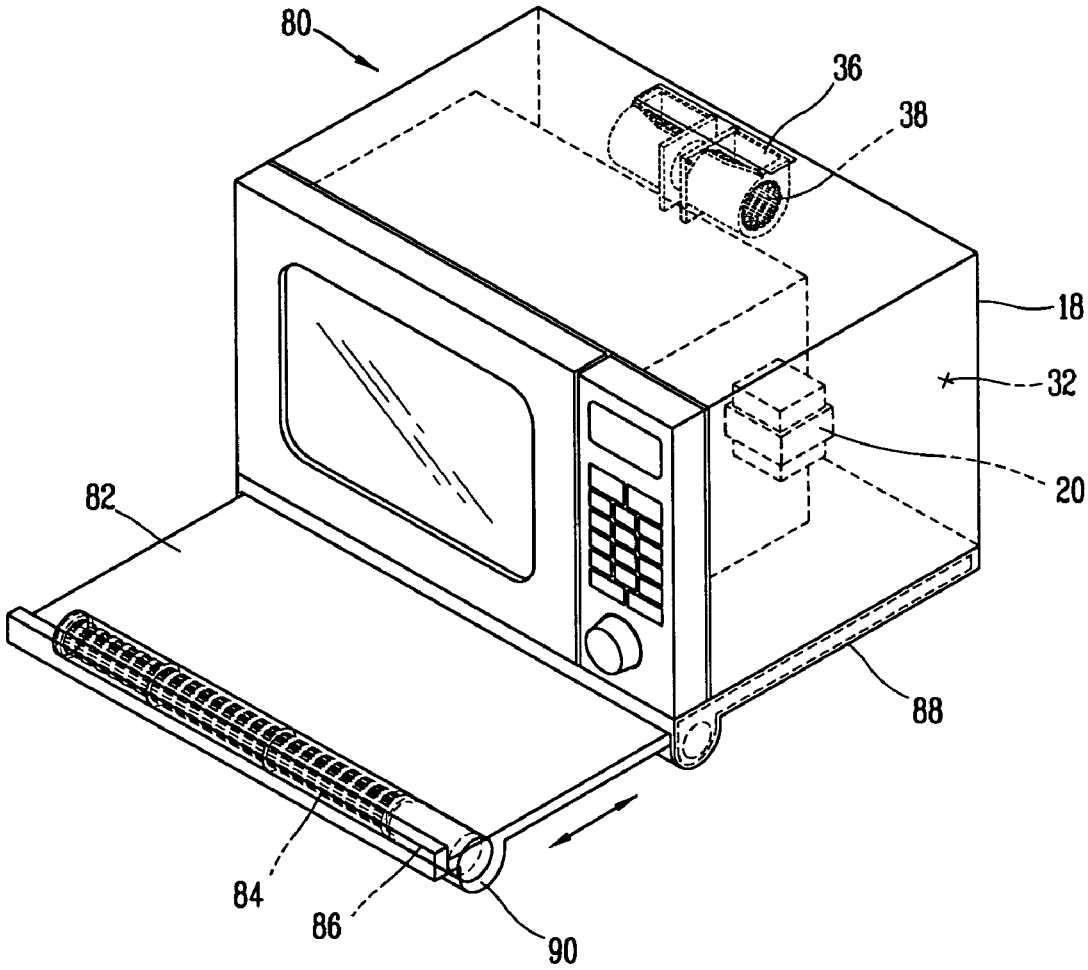
FIG. 9 is a perspective view of a combination hood microwave oven according to a third embodiment of the present invention.
Figure 10:
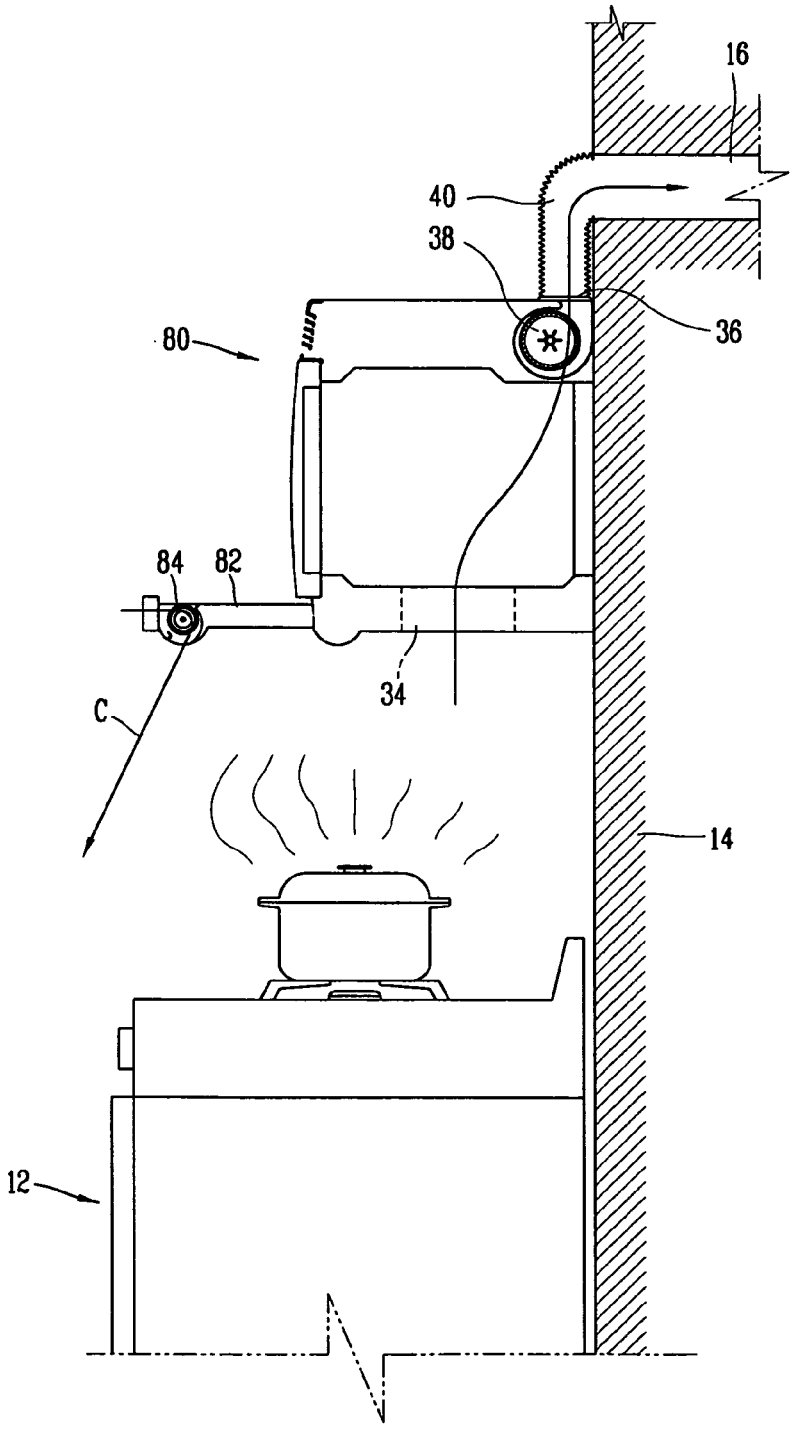
FIG. 10 is a side view of a combination hood microwave oven in use according to a third embodiment of the present invention.

FIG. 9 is a perspective view of a combination hood microwave oven according to a third embodiment of the present invention and FIG. 10 is a side view of a combination hood microwave oven in use according to a third embodiment of the present invention. And, a combination hood microwave oven according to a third embodiment of the present invention has the same construction of the first embodiment of the present invention but differs in configuration of an air curtain generating unit.

Referring to FIG. 9 and FIG. 10, a combination hood microwave oven according to a third embodiment of the present invention includes a sliding plate 82 provided to the bottom side of the cabinet 18 to slide out in front of the cabinet 18 to a predetermined displacement, a blowing fan 84 rotatably installed at a front side of the sliding plate 82 to form an air curtain C by inhaling/exhaling air, and a drive motor 86 rotating the blowing fan 84.

Guide grooves 88 are formed at the bottom side of the cabinet 18, and a fan housing 90 is provided to the front side of the sliding plate 82. The blowing fan is rotatably loaded in the fan housing 90 having an intake opening and an outflow opening.

The air curtain generating unit according to the third embodiment of the present invention compensates for an intake area of the microwave oven 80 failing to cover a cooking area of the oven range 12 in case that a size of the microwave oven 80 is relatively small or that a size of the oven range 12 is relatively large.

Specifically, if the blowing fan 84 is rotated by driving the drive motor 86 after the sliding plate 82 is drawn out to the predetermined displacement in front of the cabinet 18, room air is sucked into the fan housing by a negative blowing force of the blowing fan 84 and is then blown out in a lower direction of the cabinet 18 to form the air curtain C. In doing so, the air curtain C is formed in front of the microwave oven 80 as far as the predetermined displacement to cover a larger area enclosing the oven range 12, whereby the polluted air including hot, smelling, or humid air produced from the oven range 12 is more effectively prevented from diffusing into the room.

Besides, in addition to the air curtain generating unit according to the third embodiment of the present invention, such sliding plates 82 can be provided to both lateral sides of the cabinet 18 as well as the front side to form more air curtains to cover larger area.

Accordingly, the combination hood microwave oven according to the present invention has the following advantages or effects.

First of all, the air curtain generating unit is provided to the lower side of the microwave oven to prevent the polluted air produced from the oven range, whereby product performance is enhanced as well as the room environment can be maintained more pleasant.

Secondly, the air curtain generating units are provided to the front and both of the lateral sides of the microwave oven to form the front and side curtains, whereby the polluted air including hot, smelling, and humid air produced from the oven range is more effectively from diffusing into the room to enhance product reliance.

Finally, the sliding plate having the crossflow fan at front side is provided to the bottom side of the microwave oven to slide in and out of the microwave oven, whereby the air curtain enables to cover a larger area to enhance the product reliance and the polluted air cut-off effect.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A combination hood microwave oven comprising:

a cabinet disposed over an oven range;

a cooking unit having a predetermined cavity within the cabinet for cooking using an electromagnetic wave generated from a magnetron;

a hood unit installed within the cabinet to discharge polluted air produced from the oven range on cooking; and an air curtain generating unit installed at a front bottom side of the cabinet, the air curtain generating unit including:

a fan housing formed at the front bottom side of the cabinet, the fan housing having an intake opening at the front bottom side of the cabinet and an outflow opening at the front bottom side of the cabinet; and a blowing fan disposed at the front bottom side of the cabinet in the fan housing, the blowing fan inhaling air through the intake opening and exhaling the air through the outflow opening to form an air curtain to prevent the polluted air from diffusing into a room.

2. The combination hood microwave oven of claim 1, wherein the air curtain generating unit further comprises:

a drive motor for rotating the blowing fan.

3. The combination hood microwave oven of claim 1, wherein the blowing fan is a crossflow fan having a configuration that the air is inhaled and exhaled in a circumferential direction of the crossflow fan.

4. The combination hood microwave oven of claim 1, wherein the fan housing is formed at the front bottom side of the cabinet in a length direction, and the outflow opening inclines to a lower direction of the microwave oven to have a predetermined incline angle so that the air forming the air curtain is injected toward an upper front side of the oven range.

5. The combination hood microwave oven of claim 1, wherein the air curtain generating unit further comprises:

a left air curtain generating unit installed at a left bottom side of the cabinet to form a left air curtain inclining to a left lower side of the cabinet; and a right air curtain generating unit installed at a right bottom side of the cabinet to form a right air curtain inclining to a right lower side of the cabinet.

6. The combination hood microwave oven of claim 5, wherein each of the right and left air curtain generating units, comprises:

a blowing fan installed at the corresponding bottom side of the cabinet;

a drive motor for driving the corresponding blowing fan; and a fan housing formed at the corresponding bottom side of the cabinet to hold the corresponding blowing fan therein and having an intake opening for inhaling air and an outflow opening for exhaling air to form the corresponding air curtain.

7. The combination hood microwave oven of claim 1, wherein the air curtain generating unit further comprises:

a left air curtain generating unit installed at a left bottom side of the cabinet to form a left air curtain inclining to a left lower side of the cabinet.

8. The combination hood microwave oven of claim 1, wherein the air curtain generating unit further comprises:

a right air curtain generating unit installed at a right bottom side of the cabinet to form a right air curtain inclining to a right lower side of the cabinet.

9. The combination hood microwave oven of claim 1, wherein the blowing fan is a crossflow fan, the air curtain generating unit comprising:

a sliding plate provided to the bottom side of the cabinet, the sliding plate being slidable to in front of the cabinet to a predetermined displacement, the crossflow fan being installed at a front side of the sliding plate to form the air curtain; and a drive motor for rotating the crossflow fan.

10. The combination hood microwave oven of claim 9, wherein guide grooves are formed at the bottom side of the cabinet to have the sliding plate slide to move, the fan housing being at the front side of the sliding plate.

11. The combination hood microwave oven of claim 1, wherein the intake opening and the outflow opening being separated by a diaphragm.

* * * * *